US006470727B1

(12) United States Patent
Kunze

(10) Patent No.: US 6,470,727 B1
(45) Date of Patent: Oct. 29, 2002

(54) BENDING AND SQUEEZING BLADE FOR SHEET METAL BENDING AND SQUEEZING MACHINE AND MACHINE UTILIZING THE AFORESAID BLADE

(75) Inventor: Wolfgang Kunze, Leonding (AT)

(73) Assignee: Salvagnini Italia S.p.A. (IT)

( * ) Notice: Subject to any disclaimer, the term of this patent is extended or adjusted under 35 U.S.C. 154(b) by 0 days.

(21) Appl. No.: 09/547,070

(22) Filed: Apr. 10, 2000

(30) Foreign Application Priority Data

May 27, 1999 (IT) ..... MI99A1173

(51) Int. Cl.[7] ..... B21D 5/04
(52) U.S. Cl. ..... 72/323; 72/319
(58) Field of Search ..... 72/319, 322, 323, 72/316, 306; 29/243.58

(56) References Cited

U.S. PATENT DOCUMENTS

| | | | | | |
|---|---|---|---|---|---|
| 2,436,278 | A | * | 2/1948 | Willett | 72/319 |
| 3,662,584 | A | * | 5/1972 | Jones | 72/321 |
| 3,948,074 | A | * | 4/1976 | Stalzer | 72/319 |
| 3,983,735 | A | * | 10/1976 | Berry | 72/319 |
| 3,994,152 | A | * | 11/1976 | Wolters | 72/319 |
| 4,346,579 | A | * | 8/1982 | Takatsu | 72/319 |
| 4,356,716 | A | | 11/1982 | Aschauer et al. | 72/322 |
| 4,411,148 | A | | 10/1983 | Aschauer et al. | 72/319 |
| 5,575,169 | A | * | 11/1996 | Banse | 72/319 |

FOREIGN PATENT DOCUMENTS

| | | | | |
|---|---|---|---|---|
| DE | 79892 | * | 2/1895 | 72/323 |
| EP | 0 022 122 | | 1/1981 | |
| EP | 0 039 322 | | 11/1981 | |
| EP | 0 669 174 | | 8/1995 | |
| JP | 6-198342 | * | 7/1884 | 72/316 |
| SU | 774676 | * | 10/1980 | 72/319 |

* cited by examiner

*Primary Examiner*—Daniel C. Crane
(74) *Attorney, Agent, or Firm*—Akerman Senterfitt

(57) ABSTRACT

There is described a new bending and squeezing blade for sheet metal bending machine. The blade comprises a bending tooth provided with a head surface that is suitable to engage the edge of a sheet metal to carry out its bending at 90° and with a foot surface that is suitable to engage the 90° folded edge of the sheet metal to carry out its additional bending at an angle greater than 90° and its possible squeezing on the remaining part of the sheet metal up to an angle substantially equal to 180°. In order to assure the locking of the sheet metal during the operation of squeezing the machine preferably comprises a blank holder provided with a pressing member, that can be controlled so as to project from the support foot of the blank holder in order to lock the sheet metal on a fixed counter blade.

4 Claims, 4 Drawing Sheets

BENDING AND SQUEEZING BLADE FOR SHEET METAL BENDING AND SQUEEZING MACHINE AND MACHINE UTILIZING THE AFORESAID BLADE

The present invention concerns a bending and squeezing blade for sheet metal bending and squeezing machine and a machine utilising the aforesaid blade.

For bending the edges of sheet metal, bending machines are commonly used in which the edge of the sheet metal to be submitted to bending is squeezed between a fixed bending counter blade and a mobile blank holder above it.

The operation of bending of the edge of the sheet metal is carried out by a bending device that has one or more bending blades that collaborate with the fixed counter blade and the blank holder to actuate the upward and/or downward bending of the edge of the sheet metal, at 90° or more with respect to the resting plane of the sheet metal.

In particular, the sheet metal is bent upward owing to the action of a bending blade that is moved from bottom to top in order to carry out, in combination with the fixed counter blade and the blank holder, the upward bending of the sheet metal at 90° and then, if desired, it is moved also horizontally in order to carry out, in combination with the blank holder, an additional bending of the sheet metal until it reaches a bending angle greater than 90°.

However, the configuration of the blank holder does not allow the aforesaid bending blade to realise bending angles above a certain limit, usually of 120°–150°, and in particular it does not allow to reach an angle of 180°, corresponding to the complete squeezing of the folded edge of the sheet metal on the remaining part of the same sheet metal.

In view of this state of the art, object of the present invention is to realise a bending blade that is configured in such a way as to be able to carry out not only the bending but also the 180° squeezing of the edge of the sheet metal.

Another object is to realise a bending machine that is suitable to carry out the bending and the squeezing of the edge of a sheet metal through the aforesaid blade.

According to the invention such object is attained with a bending blade characterized in that it comprises a bending tooth provided with a head surface that is suitable to engage the edge of a sheet metal in order to carry out its bending at 90° and with a foot surface that is suitable to engage the edge of the sheet metal folded at 90° to carry out its additional bending at an angle greater than 90° and its possible squeezing on the remaining part of the sheet metal up to an angle substantially equal to 180°.

The aforesaid blade is preferably utilised to bend the edge of the sheet metal upward at an angle equal to or greater than 90° and then, if desired, its squeezing on the remaining part of the sheet metal. In order to be able to carry out the operation of squeezing it is obviously necessary to previously lift the blank holder from its engagement with the fixed counter blade. The sheet metal thus remains supported only on the counter blade and, for some types of sheet metal, a movement of the sheet metal can not be excluded that can jeopardise the execution of a correct squeezing of the folded edge of the same.

In order to obviate this possible inconvenience it is therefore provided that the blank holder is equipped with a pressing member that is operable in such a way as to be able to project downward from the foot of the blank holder so as to engage and retain the sheet metal on the counter blade by pressure.

The characteristics of the present invention will be made evident from the following detailed description of an embodiment thereof that is illustrated as a non limiting example in the enclosed drawings, in which:

FIG. 1 schematically shows, at the beginning of a bending operation, the assembly of the sheet metal locking and bending unit of a machine provided with a bending and squeezing blade according to the present invention;

Figure 1:
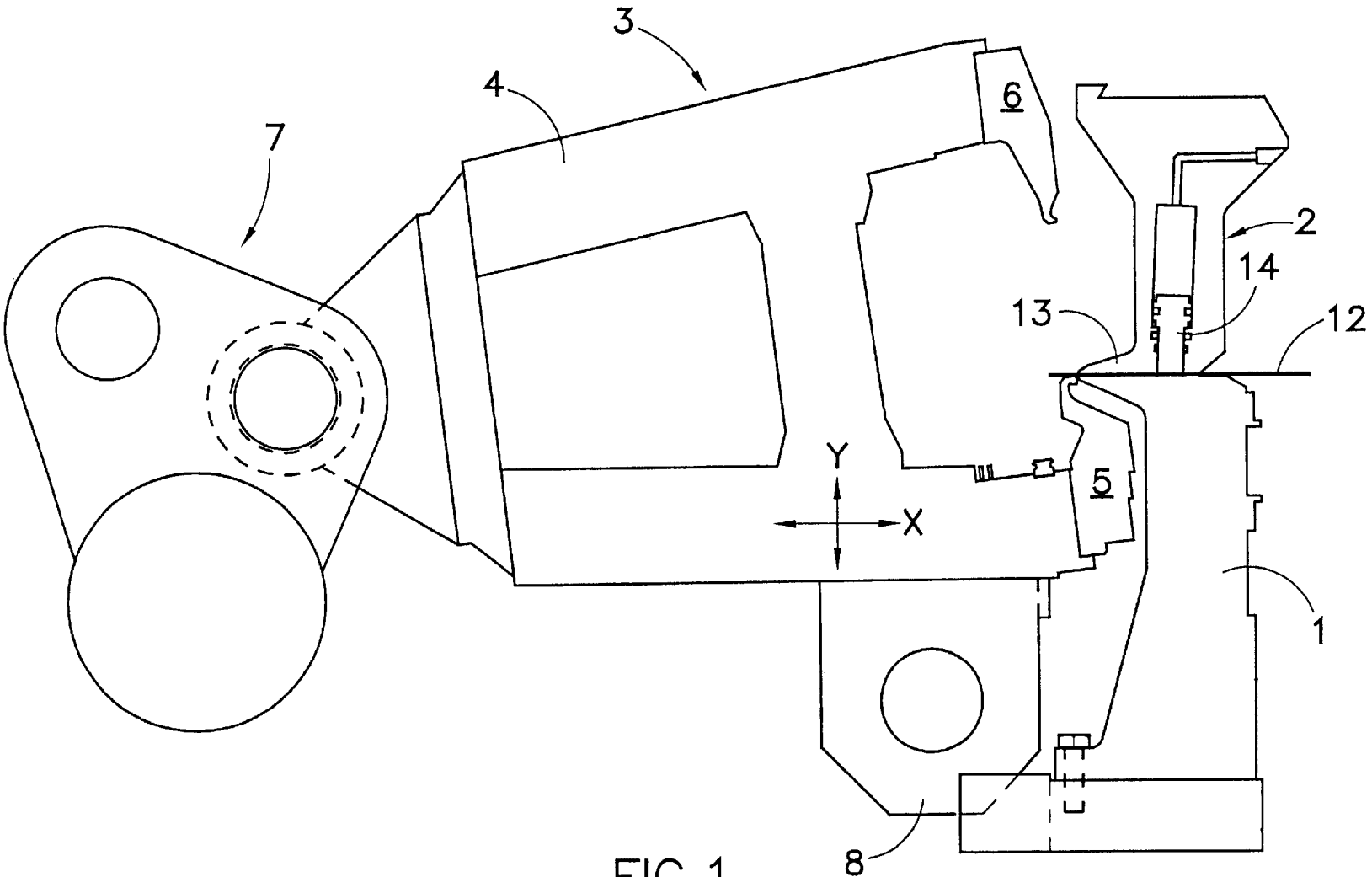

In FIG. 1 a bending unit for sheet metal is schematically shown that comprises a fixed counter blade 1, a blank holder 2 that is movable vertically toward and away from the counter blade 1 and a bending device 3 comprising a blade holder support 4 that bears a lower bending blade 5 and an upper bending blade 6. The blade holder 4 is provided with two horizontal and vertical movement mechanisms, that are properly combined to each other, the first one of which being indicated by 7 in the drawings and the second one not shown in the drawings but to be considered associated with a bracket 8 that is fixedly mounted to the blade holder. As a result, the blade holder is provided with a combined motion according to the axes X-Y.

According to the present invention the lower bending blade 5 has a bending tooth 9 provided with a head surface 10 that is suitable to engage the edge of a sheet metal in order to carry out, in combination with a substantially perpendicular front surface 15, its upward bending at an angle of 90° and with a substantially horizontal foot surface 11 that is suitable to engage the 90° folded edge of the sheet metal so as to carry out its additional bending at an angle greater than 90° and its possible squeezing on the remaining part of the sheet metal up to an angle substantially equal to 180°.

Figure 2:
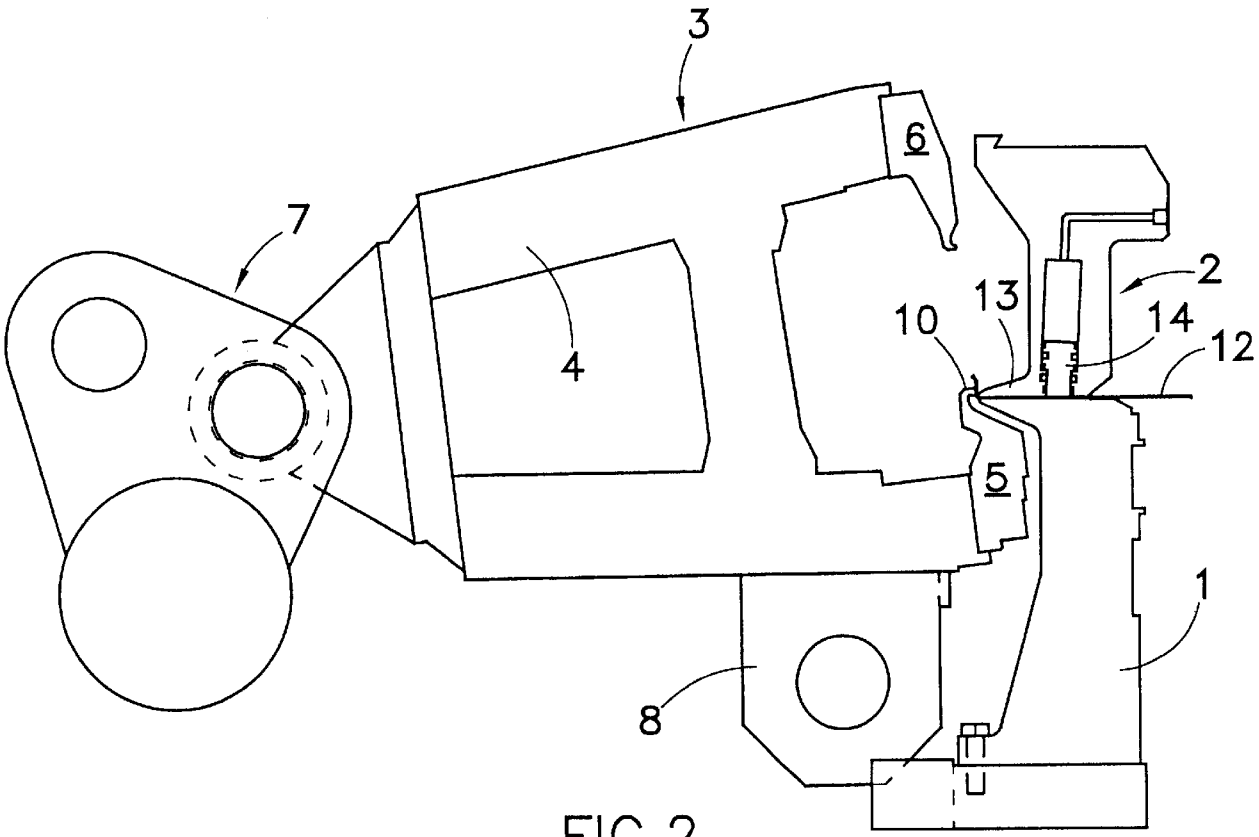
FIGS. 2, 3 and 4 show the same assembly during upward bending operations of the edge of a sheet metal, first at 90° and then above 90°, and finally during the stage of squeezing of the folded edge of the sheet metal.

During operation, the edge 12 of a sheet metal to be bent is squeezed between the counter blade 1 and the blank holder 2 (FIG. 1) and by vertical displacement of the blade holder 4 the head surface 10 and then the front surface 15 of the lower bending blade 5 are brought in engagement with the lower face of the edge of the sheet metal so as to cause its upward bending, at 90° with reference to the rest of the sheet metal (FIG. 2).

Figure 3:
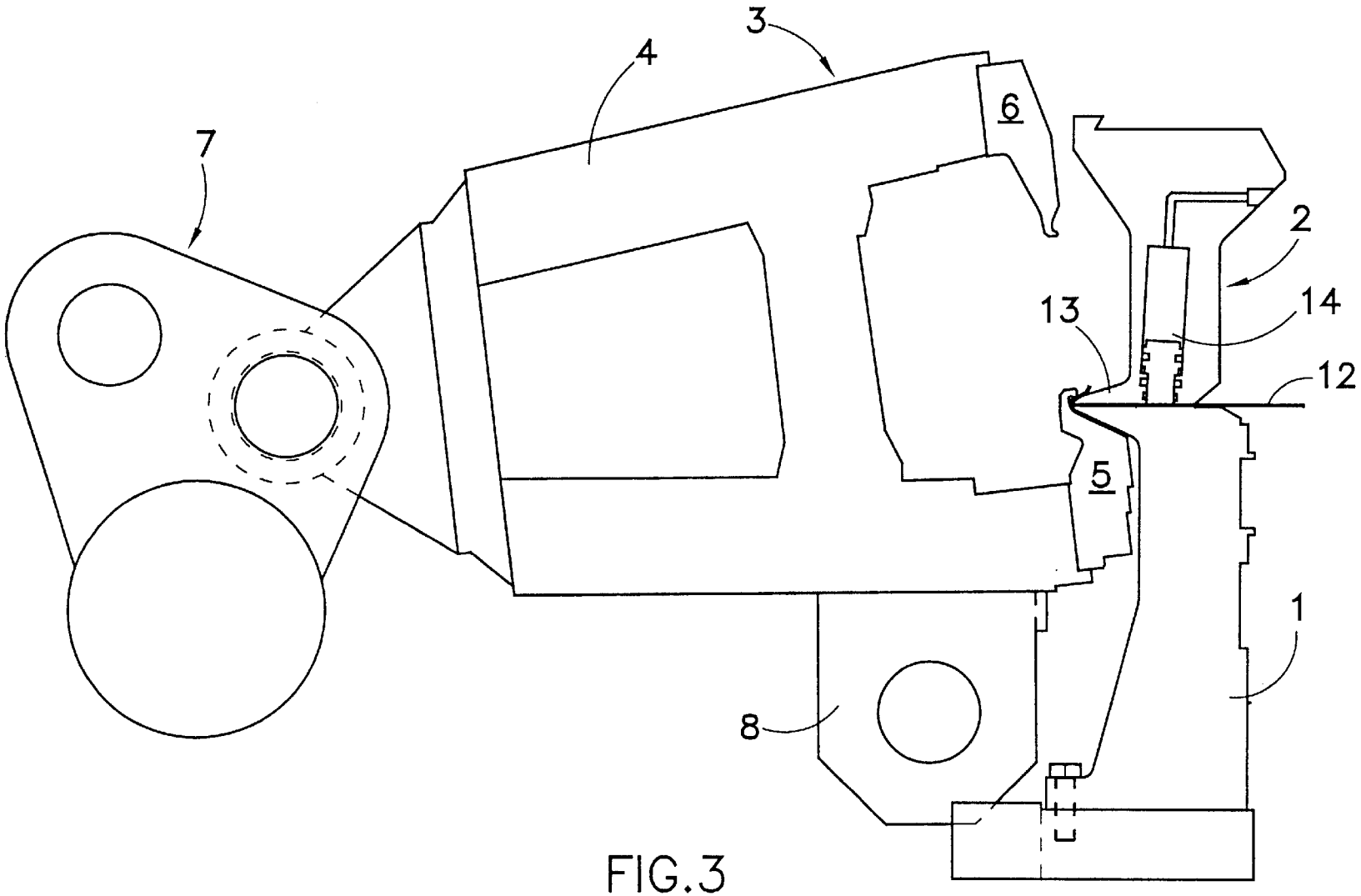

Subsequently, by controlling also a limited horizontal movement of the bending blade 5, it is possible to extend the bending of the edge of the sheet metal at an angle greater than 90°, by using to such purpose the foot surface 11 of the lower blade 5 as a bending tool and the support foot 13 of the blank holder 2 as a counter blade, as shown in FIG. 3.

Figure 5:
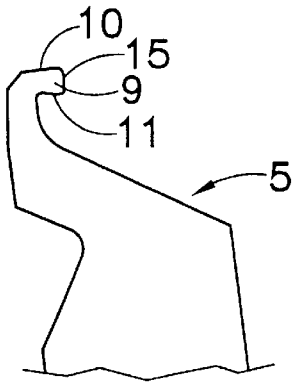
FIG. 5 shows in a magnified scale the operating part of the blade according to the invention.

Finally, after having lifted the blank holder, the foot surface 11 of the lower bending blade 5 can be utilised to carry out the complete squeezing of the folded edge 16 of the sheet metal on the immediately following portion of the same sheet metal, that is still resting on the counter blade 1. To such purpose the foot surface 11 is slightly tilted upward starting from its end that is facing toward the fixed counter blade 1, or it can be provided with a corresponding concavity (FIG. 5), in order to receive the curve of the squeezed sheet metal.

Figure 4:
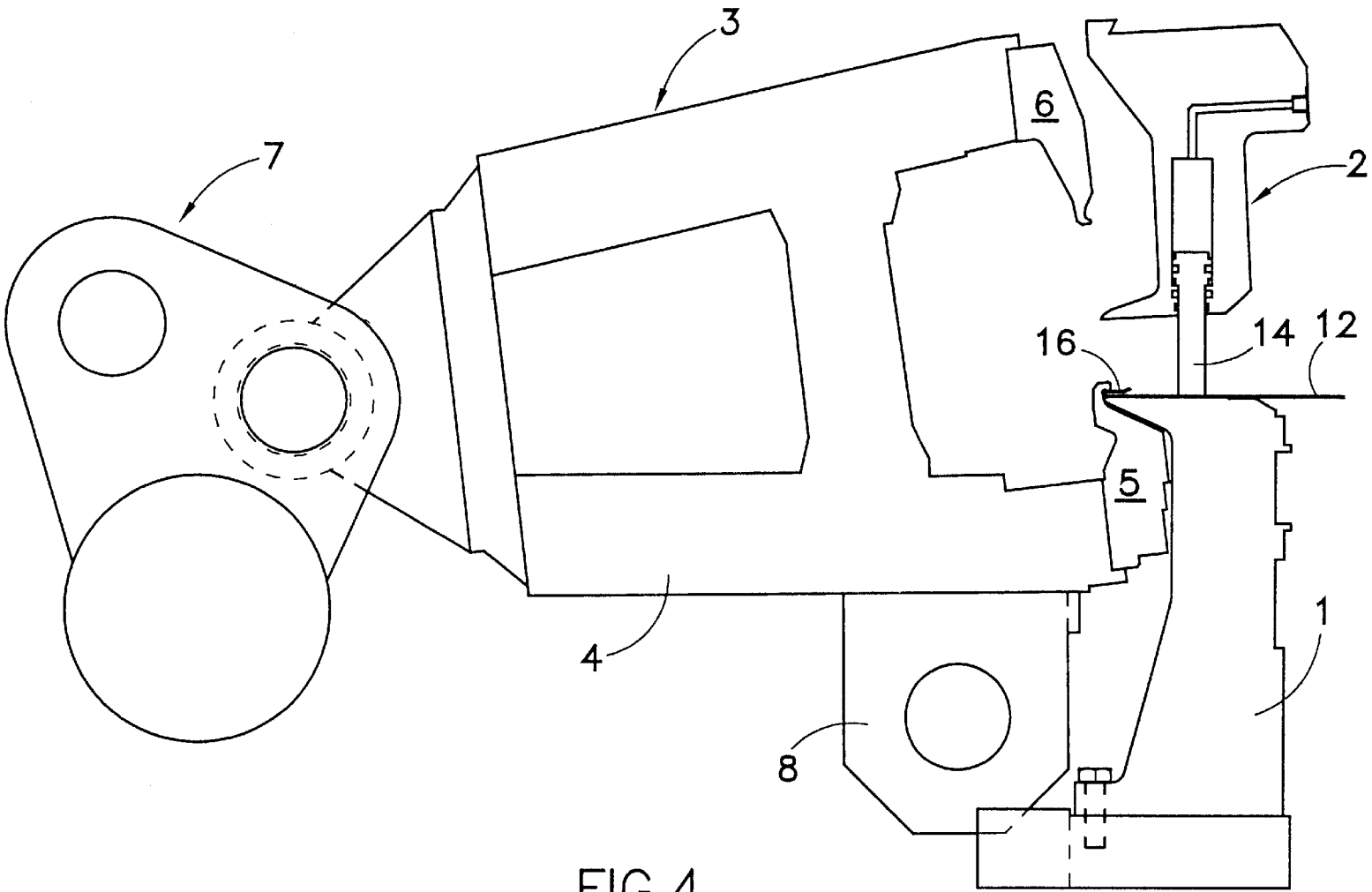

During such operation, in order to keep the sheet metal in position on the counter blade, the blank holder 2 can be provided with a pressing member 14, that can be controlled hydraulically to project downward from the foot of the blank holder to lock the sheet metal 12 from above onto the fixed counter blade 1, as shown in FIG. 4.

What is claimed is:

1. A machine for bending and squeezing a sheet metal, comprising:

a fixed counterblade which defines a resting plane for the sheet metal;

a mobile blank holder which is movable towards the counterblade to lock the sheet metal on said resting plane;

a bending blade which is movable and engageable with the counterblade and the blank holder in order to bend and squeeze a peripheral edge of the sheet metal; and bending blade driving means for moving the bending blade in perpendicular and parallel directions with respect to said resting plane, wherein said bending blade is provided with a bending tooth having a head surface for causing bending of the peripheral edge of the sheet metal at an angle of 90° with respect to said resting plane and a foot surface for causing subsequent bending of said peripheral edge to an angle greater than 90° with respect to said resting plane and subsequent squeezing of said peripheral edge onto a remaining part of the sheet metal up to an angle substantially equal to 180° with respect to said resting plane, wherein said foot surface is substantially parallel to said resting plane and is provided with a concavity for receiving a curved portion of the peripheral edge of the sheet metal when bent.

2. A machine for bending and squeezing a sheet metal, comprising:

a fixed counterblade which defines a resting plane for the sheet metal;

a mobile blank holder which is movable towards the counterblade to lock the sheet metal on said resting plane;

a bending blade which is movable and engageable with the counterblade and the blank holder in order to bend and squeeze a peripheral edge of the sheet metal; and bending blade driving means for moving the bending blade in perpendicular and parallel directions with respect to said resting plane, wherein said bending blade is provided with a bending tooth having a head surface for causing bending of the peripheral edge of the sheet metal at an angle of 90° with respect to said resting plane and a foot surface for causing subsequent bending of said peripheral edge to an angle greater than 90° with respect to said resting plane and subsequent squeezing of said peripheral edge onto a remaining part of the sheet metal up to an angle substantially equal to 180° with respect to said resting plane, wherein said foot surface is substantially parallel to said resting plane and is slightly inclined toward said head surface from a front end faced to the sheet metal to a rear end.

3. A machine for bending and squeezing a sheet metal, comprising:

a fixed counterblade which defines a resting plane for the sheet metal;

a mobile blank holder which is movable towards the counterblade to lock the sheet metal on said resting plane;

a bending blade which is movable and engageable with the counterblade and the blank holder in order to bend and squeeze a peripheral edge of the sheet metal; and bending blade driving means for moving the bending blade in perpendicular and parallel directions with respect to said resting plane, wherein said bending blade is provided with a bending tooth having a head surface for causing bending of the peripheral edge of the sheet metal at an angle of 90° with respect to said resting plane and a foot surface for causing subsequent bending of said peripheral edge to an angle greater than 90° with respect to said resting plane and subsequent squeezing of said peripheral edge onto a remaining part of the sheet metal up to an angle substantially equal to 180° with respect to said resting plane, wherein said head and foot surfaces are connected by a substantially perpendicular front surface.

4. A machine for bending and squeezing a sheet metal, comprising:

a fixed counterblade which defines a resting plane for the sheet metal;

a mobile blank holder which is movable towards the counterblade to lock the sheet metal on said resting plane;

a bending blade which is movable and engageable with the counterblade and the blank holder in order to bend and squeeze a peripheral edge of the sheet metal; and bending blade driving means for moving the bending blade in perpendicular and parallel directions with respect to said resting plane, wherein said bending blade is provided with a bending tooth having a head surface for causing bending of the peripheral edge of the sheet metal at an angle of 90° with respect to said resting plane and a foot surface for causing subsequent bending of said peripheral edge to an angle greater than 90° with respect to said resting plane and subsequent squeezing of said peripheral edge onto a remaining part of the sheet metal up to an angle substantially equal to 180° with respect to said resting plane, wherein the blank holder is provided with a pressing member which is driven to project from a bottom surface of the blank holder to lock the sheet metal onto said counterblade during squeezing of the peripheral edge of the sheet metal.

* * * * *